US007841025B1

(12) United States Patent
Fink et al.

(10) Patent No.: US 7,841,025 B1
(45) Date of Patent: Nov. 30, 2010

(54) JAW PAD COVER

(76) Inventors: Joshua M. Fink, 5 Ivy Rd., Wellesley, MA (US) 02482; Robbie M. Storey, 401 S. Greenbrier Rd., Nocona, TX (US) 76255

( * ) Notice: Subject to any disclaimer, the term of this patent is extended or adjusted under 35 U.S.C. 154(b) by 1577 days.

(21) Appl. No.: 11/141,851

(22) Filed: Jun. 1, 2005

(51) Int. Cl.
*A42B 3/00* (2006.01)
*A63B 71/10* (2006.01)

(52) U.S. Cl. ..... 2/414; 2/425

(58) Field of Classification Search ..... 2/421, 2/414, 411, 410, 424, 422, 425, 9
See application file for complete search history.

(56) References Cited

U.S. PATENT DOCUMENTS 2,863,151 A * 12/1958 Morgan, Jr. ..... 2/414
4,916,759 A * 4/1990 Arai ..... 2/414
4,937,888 A * 7/1990 Straus ..... 2/411
6,185,753 B1 * 2/2001 Arai ..... 2/414
6,282,725 B1 9/2001 Vanidestine, Jr.
6,370,699 B1 4/2002 Halstead et al.
6,438,762 B1 * 8/2002 Jenkins ..... 2/414
D492,818 S * 7/2004 Ide et al. ..... D29/122

* cited by examiner

*Primary Examiner*—Gary L Welch
*Assistant Examiner*—Amber R Anderson
(74) *Attorney, Agent, or Firm*—Joseph R. Birkner

(57) ABSTRACT

A jaw pad cover for expandably conforming to a shape of a jaw pad for protectively covering the jaw pad of a headgear is provided. The jaw pad cover comprises a stretchable material blank having a first section and a second section joined together with a stitch. The means for receiving the jaw pad therein the jaw pad cover is therethrough a first aperture and a second aperture therein the first section. The first aperture is larger than the second aperture to allow the jaw pad to freely pass therethrough so that when the jaw pad is positioned therein the jaw pad cover, a fastening means on the jaw pad for receiving the jaw pad and the jaw pad cover on the headgear is accessible therethrough the second aperture.

13 Claims, 5 Drawing Sheets

JAW PAD COVER

FIELD OF THE INVENTION

This invention relates generally to a cover for a jaw pad. More particularly, the present invention relates to a stretchable jaw pad cover for protectively covering a jaw pad of a headgear.

BACKGROUND OF THE INVENTION

Jaw pads are used on headgear particularly on football helmets to protect the jaw of a user from shock caused by impact from a blow to the body such as from a tackle or from a block during a football game. It is noted that although the discussion herein, for clarity, illustratively mentions football helmets, it is understood that other types of headgear such as those worn by fighters when boxing, wrestlers, bicycle and motorcycle riders, automobile racing drivers, soccer players, hockey players, lacrosse players, baseball players, firefighters, military personnel and any other types of headgear where a jaw pad is supplied will encompass the intent and meaning of this disclosure without departing therefrom.

The typical protective helmet has a rigid outer shell made of a hard plastic-like material. Secured to the internal surface of the shell is a padding structure that is fitted to the wearer's head for absorbing the force of impact to the helmet. The padding structure has of a plurality of resilient pads removably secured to the inside surface of the helmet shell. The pads are of varying shapes designed to protect specific portions of the wearer's head. Furthermore, the pads are interchangeable and are available in a range of thickness' such that the helmet shell can accommodate different sized heads.

To removably secure the pads to the helmet shell, a plurality of sets of male snap members are fixed to the inner surface of the shell. Each of the resilient pads is provided with a set of female snap members for mateably engaging one of the sets of male snap members. The pads can be simply and easily removed and replaced by "snapping-out" one pad and "snapping-in" another pad. The pads are designed to be easily removed and replaced so that the user, for example an athletic team's equipment manager, can easily replace worn, damaged or discolored pads and can replace pads of one thickness with pads of a different thickness such that the helmet can be custom fitted to different size heads.

The known padding structure includes a pair of jaw pads arranged one each on the left-hand and right-hand sides of the shell. Typically, a set of three or more male snap members is arranged on each of the left-hand and right-hand ear flaps to engage three or more female snap members formed on the associated jaw pad.

Although various shapes and designs of jaw pads exist, jaw pads currently in use are basically U-shaped and are mounted on the earflaps of the shell below the ear holes to protect the hinge area of the wearer's jaw.

Typical jaw pads have a resilient inner material encased with a bland white or creme colored vinyl outer casing. The problem with such jaw pads is that, when in contact with a jaw of a user, they are uncomfortable, cold to the touch during cold weather and can slide when subjected to perspiration or when jostled and can thereby interfere with the desired operation during, for example, a football game when they can cause the helmet to slip, which may cause an undesirable equipment malfunction type of injury. Another problem with typical jaw pads is that they can cause skin irritations such as chaffing or a rash and are not suitable for receiving the application of anti-microbial topical products such as Microban™ thereupon. Also, the white or creme colored outer casing of the jaw pad is non aesthetically pleasing; it shows dirt and grass stains, is difficult to clean and is not lauderable. It is also costly and time consuming to replace a jaw pad. Furthermore, due to sanitary reasons, the typical jaw pads are unusable by other team members. Since jaw pads are functional padding, and because they are matched sets, no one recognized the need to identify and to associate a particular set of jaw pads with a particular user, by name, number or even by a team color or logo.

The inventors are unaware of the existence of or the knowledge of any prior attempts by others to cover a jaw pad with a jaw pad cover and by the method as disclosed herein and believe that they are the first to do so. Jaw pads were never intended to be covered because they were considered complete and intact by themselves and were used strictly for padding and no one recognized the need to cover them. The inventors recognized a never before addressed problem and fulfilled a need which overcomes the limitations and issues associated with jaw pads.

In view of the above mentioned problems and limitations associated with conventional jaw pads, it was recognized by the present inventors that there is an unfulfilled need for a jaw pad cover which readily stretchably fits over a variety of shapes and sizes of jaw pads, is sanitary, aesthetic, functional, readily identifiable and minimizes the need to replace jaw pads when they become soiled or slightly damaged and are still generally usable. Accordingly, it becomes clear that there is a great need for a jaw pad cover which overcomes the disadvantages associated with jaw pads of the prior art. Such a jaw pad cover should be one that works as desired, is easy to use and is economically manufactured.

SUMMARY OF THE INVENTION

It is therefore an object of this invention to provide a jaw pad cover which avoids the aforementioned problems of prior art jaw pads.

It is another object of this invention to provide a jaw pad cover that is expandably stretchable over a jaw pad.

It is another object of this invention to provide a jaw pad cover which is readily adaptable for fitting over various shapes of jaw pads.

It is another object of this invention to provide a jaw pad cover that extends the usable life of a jaw pad.

It is a further object of this invention to provide a jaw pad cover that is sanitary and may be used with anti-microbial products.

It is a further object of this invention to provide a jaw pad cover that reduces chaffing or the formation of a rash.

It is a further object of this invention to provide a jaw pad cover that is launderable.

It is another object of this invention to provide a jaw pad that identifies and associates a particular set of jaw pads with a particular user, by name, number or even by a team color or logo.

It is another object of this invention to provide a jaw pad cover that requires no modification to a jaw pad or to the jaw pad fastening means.

It is a further object of this invention to provide a jaw pad cover which may be manufactured from readily available materials by conventional manufacturing processes.

It is still a further object of this invention to provide a jaw pad cover that is simple in design, simple to manufacture, low in cost, safe and is easy and fun to use.

This invention results from the realization that there is a great need for an aesthetic and highly functional jaw pad cover; the resulting invention provides such benefits.

According to a first aspect of the present invention, disclosed is a jaw pad cover for expandably conforming to a shape of a jaw pad for protectively covering the jaw pad of a headgear. The jaw pad cover comprises a stretchable material blank having a first section and a second section. The means for joining the first section to the said second section of the stretchable material blank is a stitch. The means for receiving the jaw pad therein the jaw pad cover is therethrough a first aperture and therethrough a second aperture therein the first section. The first aperture therein the first section is larger than the second aperture therein the first section to allow the jaw pad to freely pass therethrough so that when the jaw pad is positioned therein the jaw pad cover, a fastening means, on the jaw pad for receiving the jaw pad and the jaw pad cover on the headgear, is accessible therethrough the second aperture therein the first section.

The second aspect, in accordance with the present invention, is a special case of the first aspect of this invention with additional features. The first aperture and the second aperture in the first section have reinforcement sewn thereabout.

The third aspect of the present invention discloses a method of fabricating a jaw pad cover.

The fourth aspect of the present invention discloses a method for protectively covering a jaw pad of a headgear

DETAILED DESCRIPTION OF ILLUSTRATIVE EMBODIMENTS

Figure 1:
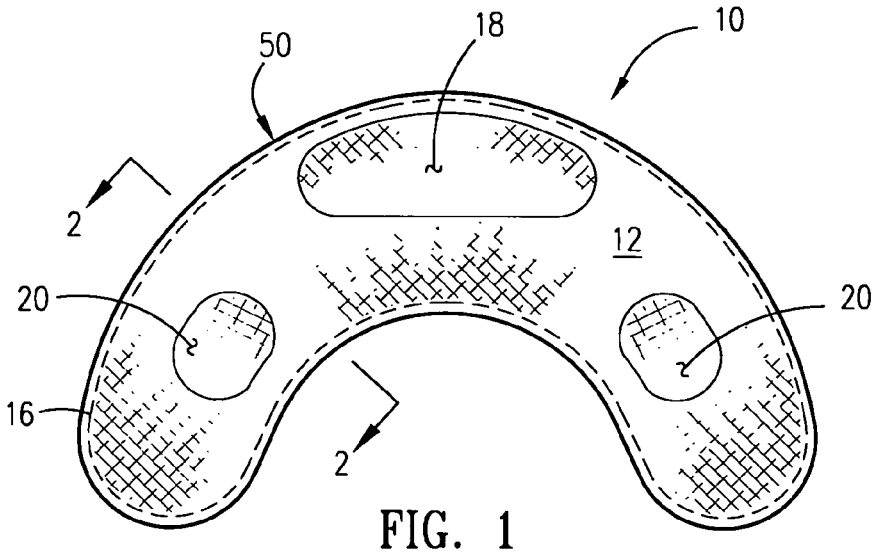
FIG. 1 is a right side elevation view of an embodiment of a jaw pad cover of the instant invention in an unexpanded condition showing a first section of a material blank with a stitch shown in a broken line.
Figure 2:
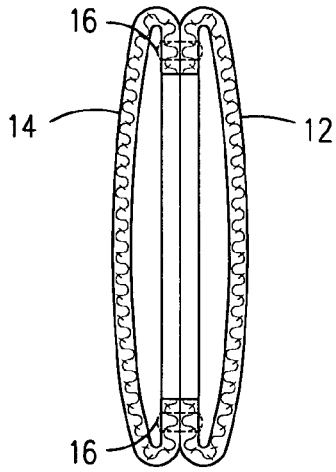
FIG. 2 is a cross sectional view taken along the plane 2-2 of the instant invention of FIG. 1.
Figure 3:
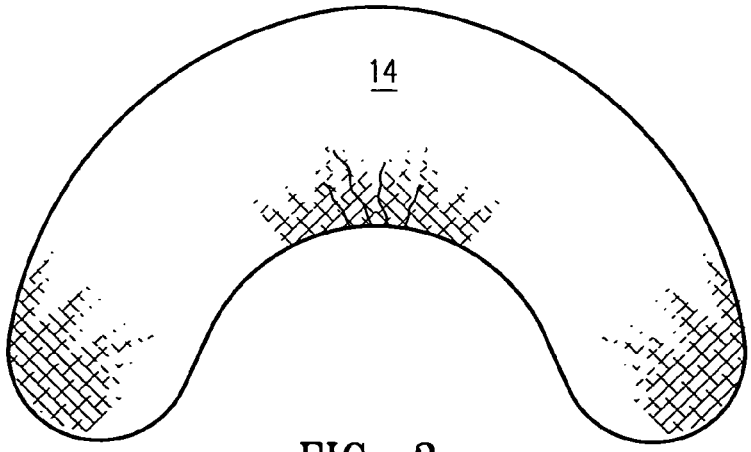
FIG. 3 is a left side elevation view of the instant invention of FIG. 1 showing a second section of the material blank.

Looking more particularly to the drawings, there is shown in FIGS. 1 to 3 an illustrative embodiment of a jaw pad cover, which is generally indicated at 10, according to an embodiment of the present invention.

FIG. 1 is a right side elevation view of an embodiment of a jaw pad cover 10 of the instant invention in an unexpanded condition showing a first section 12 of a material blank 50 with a stitch 16 shown in a broken line.

As best seen in FIG. 1, the jaw pad cover 10, for expandably conforming to a shape of a jaw pad 30 (shown in FIG. 4) for protectively covering the jaw pad 30 of a headgear 40 (shown in phantom in FIG. 5) comprises a stretchable material blank 50 having the first section 12 and a second section 14. The means for joining the first section 12 to the second section 14 of the stretchable material blank 50 is a stitch 16. The stretchable material blank 50 is fabricated from one of a natural material and a synthetic material. The natural material and the synthetic material of the stretchable material blank 50 is a material chosen from the group consisting of nylon, rayon, orlon, rubber, cotton, silk, wool, plastic, Spandex® and Lycra®. The jaw pad cover 10 may be fabricated from a combination of materials. For example, such as, but not limited to, the first section 12 may be fabricated from an elastomeric material such as rubber and the second section 14 may fabricated from one of nylon, rayon, orlon, cotton, silk, wool, plastic, Spandex® and Lycra®. In another example, the first section 12 and the second section 14 are fabricated from a single material such as, but not limited to, one of nylon, rayon, orlon, rubber, cotton, silk, wool, plastic, Spandex® and Lycra®. Various colors and textures and of materials may be used. Although not necessary for operation, sports team colors, indicia, logos and player numbers for uniform and for equipment coordination and for easy identification may be provided on the jaw pad cover 10. Also, anti-microbial products such as, for example, Microban™ may be applied to the jaw pad cover 10 to reduce chaffing or the formation of a rash.

FIG. 2 is a cross sectional view taken along the plane 2-2 of the instant invention of FIG. 1. In this example, the jaw pad cover 10 is shown fabricated from a combination of materials with the first section 12 fabricated from an elastomeric material such as rubber and the second section 14 fabricated from one of nylon, rayon, orlon, cotton, silk, wool, plastic, Spandex® and Lycra®.

FIG. 3 is a left side elevation view of the instant invention of FIG. 1 showing the second section 14 of the material blank 50.

Figure 4:
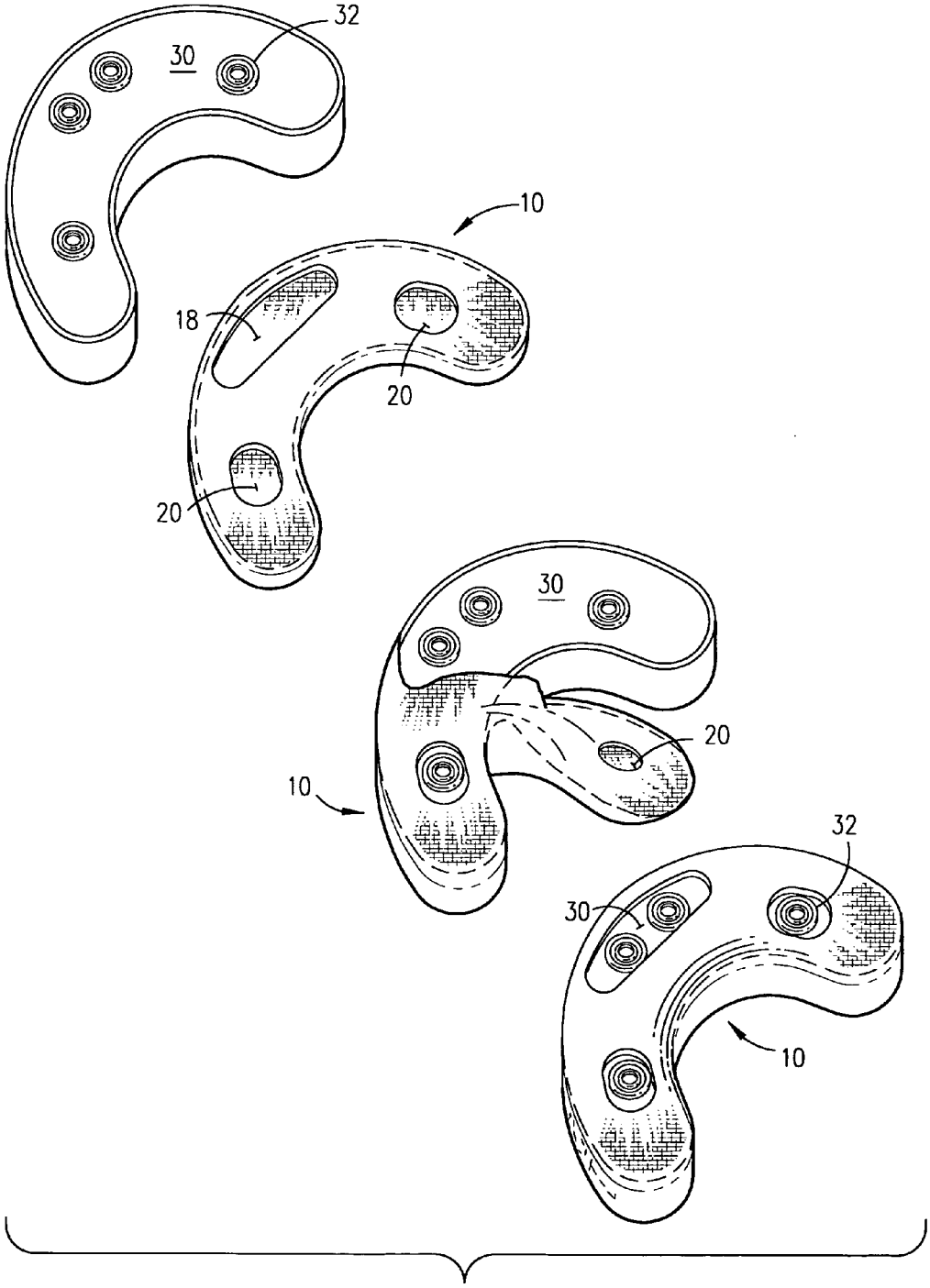
FIG. 4 is a perspective view showing an assembly sequence of the jaw pad cover of FIG. 1 covering a jaw pad and the jaw pad cover shown in a final expanded condition.
Figure 5:
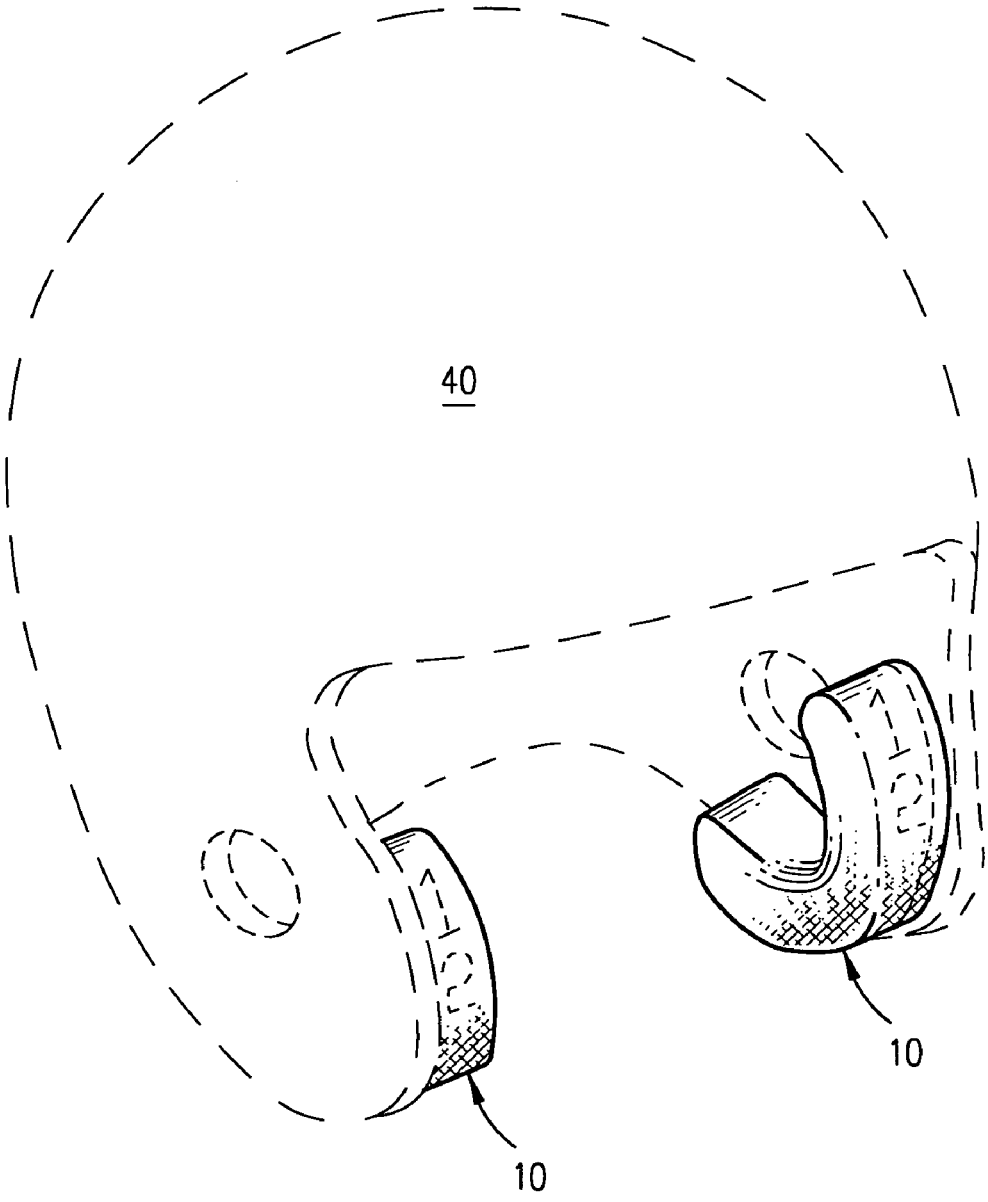
FIG. 5 is a perspective view showing the jaw pad cover of FIG. 1 installed on a headgear shown in phantom.

As best seen in FIG. 4, the means for receiving the jaw pad 30 therein the jaw pad cover 10 is therethrough a first aperture 18 and therethrough a second aperture 20 therein the first section 12. The first aperture 18 is larger than the second aperture 20 to allow the jaw pad 30 to freely pass therethrough so that when the jaw pad 30 is positioned therein the jaw pad cover 10, a fastening means 32 on the jaw pad 30 for receiving the jaw pad 30 and the jaw pad cover 10 on the headgear 40 (shown in phantom in FIG. 5) is accessible therethrough the second aperture 20.

In operation, a user simply stretches the jaw pad cover 10 over the jaw pad 30.

The applicants have actually reduced the invention to practice by constructing working prototypes according to the teachings of this invention as illustrated in EXAMPLES 1 and 2.

Example 1

A prototype of the jaw pad cover 10 was constructed from readily available materials and was successfully tested.

In this illustrative example, the jaw pad cover 10 was made from a material blank 50 with the first section 12 made of a rubberized fabric material capable of being die cut and the second section 14 was fabricated from Spandex® and joined together by a stitch 16. Being readily available, the material blank 50 was black in color. The first section 12 had a close woven rubberized fabric material and the second section 14 had a herring bone pattern. The jaw pad cover 10 was dimensioned to correspond to fit a jaw pad 30 having a crescent shape with a size of about 4 inches (10.2 cm) long by 1¼ inches (3.2 cm) wide by 1 inch thick (2.5 cm) with the fastening means 32 comprising four female snap members for matingly mounting thereon the headgear 40 via corresponding male snap members (not shown). The first section 12 has a first aperture 18 and a second aperture 20 therein to accommodate the jaw pad 30 and the fastening means 32. The first aperture 18 being larger than the second aperture 20 to allow the jaw pad 30 to freely pass therethrough and the fastening means 32 on the jaw pad 30 being visible and accessible for mounting on the headgear 40. The completed jaw pad cover 10 was stretched over the jaw pad 30 and was found to protectively cover the jaw pad 30 in the desired manner.

Another illustrative embodiment of a jaw pad cover 10A is shown in FIGS. 6 to 9. Construction and operation is similar to the illustrative embodiment of the jaw pad cover 10 described above.

Figure 6:
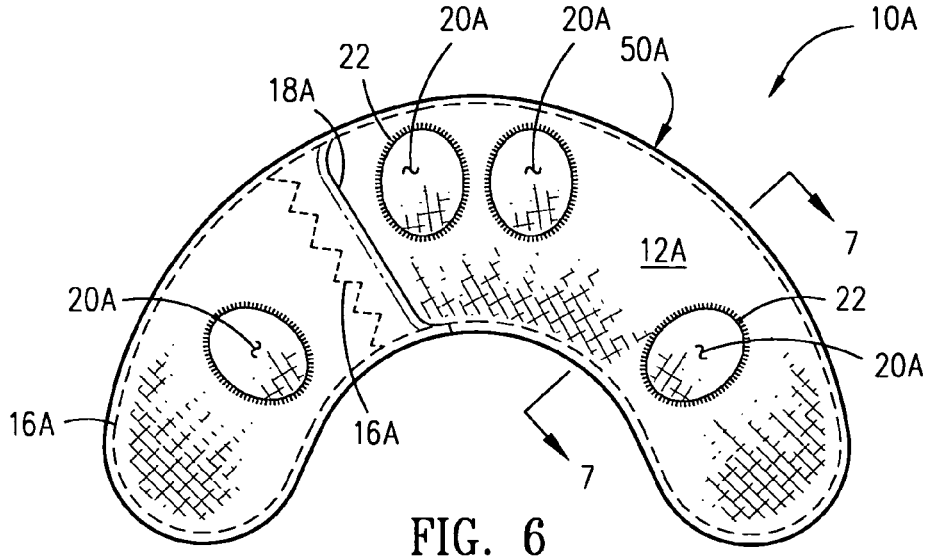
FIG. 6 is a right side elevation view of another embodiment of a jaw pad cover of the instant invention in an unexpanded condition showing a first section of a material blank with a stitch shown in a broken line.

FIG. 6 is a right side elevation view of another illustrative embodiment of a jaw pad cover 10A of the instant invention in an unexpanded condition showing a first section 12A of a material blank 50A with a stitch 16A shown in a broken line. Also shown is the first section 12A with a first aperture 18A having the stitch 16A disposed in a saw tooth pattern and a second aperture 20A with a sewn reinforcement 22 thereabout. The first section 12A and the second section 14A are joined together by the stitch 16A as best seen in FIGS. 7 and 9.

Figure 7:
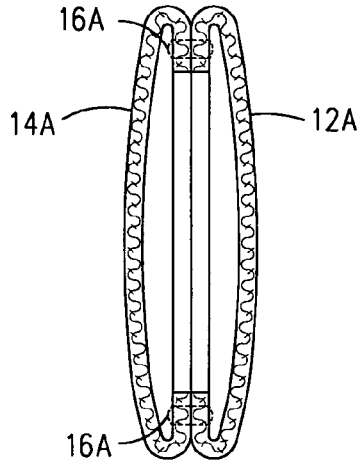
FIG. 7 is a cross sectional view taken along the plane 7-7 of the instant invention of FIG. 6.

FIG. 7 is a cross sectional view taken along the plane 7-7 of the instant invention of FIG. 6. In this example, the jaw pad cover 10A is shown with the first section 12A and the second section 14A fabricated from one of nylon, rayon, orlon, rubber, cotton, silk, wool, plastic, Spandex® and Lycra®.

Figure 8:
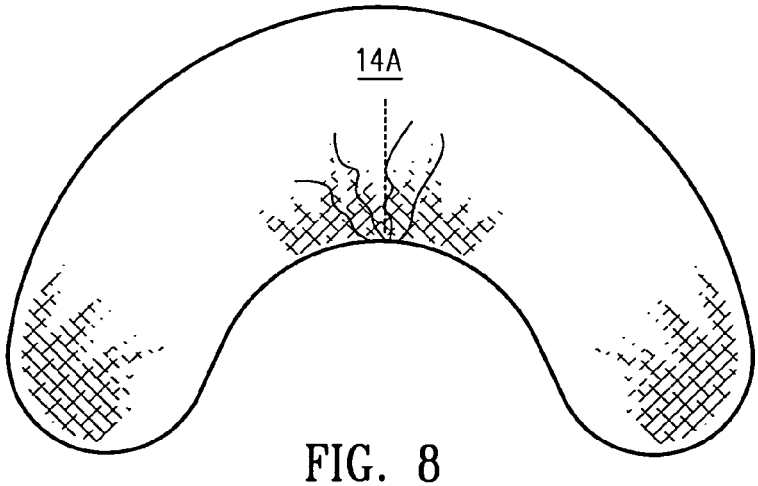
FIG. 8 is a left side elevation view of the instant invention of FIG. 6 showing a second section of the material blank.

FIG. 8 is a left side elevation view of the instant invention of FIG. 6 showing the second section 14A of the material blank 50A.

Figure 9:
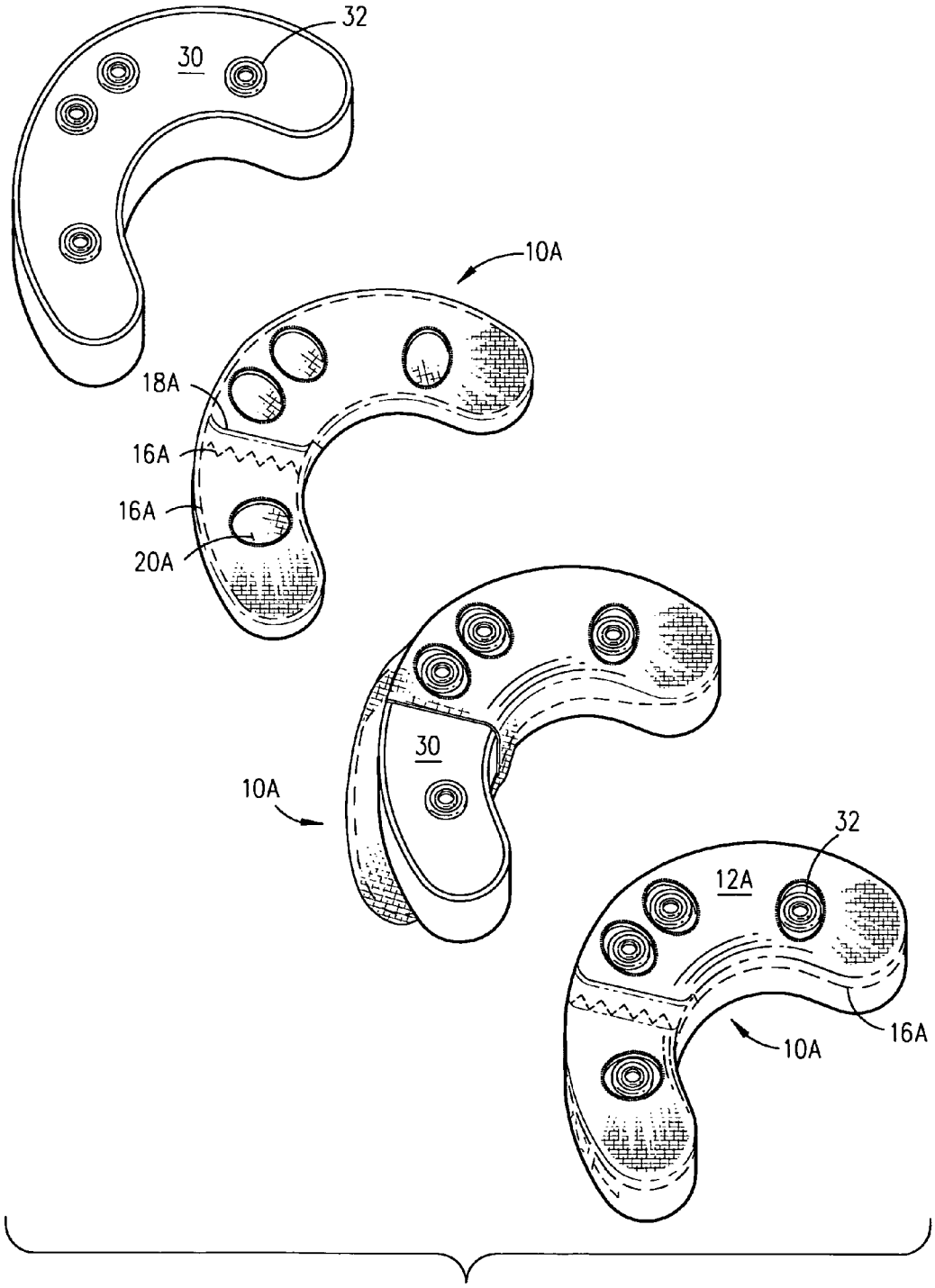
FIG. 9 is a perspective view showing an assembly sequence of the jaw pad cover of FIG. 6 covering a jaw pad and the jaw pad cover shown in a final expanded condition.

FIG. 9 is a perspective view showing an assembly sequence of the jaw pad cover 10A covering a jaw pad 30 and the jaw pad cover 10A shown in a final expanded condition.

Example 2

A second prototype of the jaw pad cover 10A was constructed from readily available materials and was successfully tested.

In this second illustrative example, the jaw pad cover 10A was made from a material blank 50A with the first section 12A and the second section 14A fabricated from Spandex® and joined together by a stitch 16A. Being readily available, the material blank 50A was red in color. The jaw pad cover 10A was dimensioned and generally constructed to correspond to fit the jaw pad 30 in a manner as in EXAMPLE 1. The first aperture 18A being larger than the second aperture 20A to allow the jaw pad 30 to freely pass therethrough and the fastening means 32 on the jaw pad 30 being visible and accessible for mounting on the headgear 40. The first aperture 18A has the stitch 16A disposed in a saw tooth pattern and a second aperture 20A with a sewn reinforcement 22 thereabout. The completed jaw pad cover 10A was stretched over the jaw pad 30 and was found to cover the jaw pad 30 in the desired manner.

The inventors recognized that a material capable of being stretchable over the jaw pad 30 and being able to recover to its original shape was a desirable property of the jaw pad cover 10 and 10A. The inventors found that a polyurethane with a long-chain synthetic polymeric fiber such as DuPont Corporation's Spandex™ having soft and rubbery segments of polyester or polyether polyols allow the fiber to stretch up to 600% and then recover to its original shape worked well. Hard segments, usually urethanes or urethane-ureas, provide rigidity and to impart tensile strength and limit plastic flow. Originally designated Fiber K™, DuPont Corporation subsequently chose the more mellifluous trade name Lycra™ to distinguish its brand of Spandex™ fiber. Always blended with other natural and man-made fibers such as cotton, wool, silk, and linen, Spandex™ is lighter in weight than rubber thread. And unlike rubber thread, Spandex™ does not break down with exposure to body oils, perspiration, lotions, detergents or anti-microbial products such as, for example, Microban™ in the desired application.

From the above, it is understood that the jaw pad cover 10 and 10A may be fabricated from a wide variety and combinations of stretchable materials and in a various styles, colors, shapes and designs and being fully capable and readily adaptable to fit any geometric configuration without departing from this disclosure.

The applicants have recognized a need and have solved a heretofore unknown problem in the prior art in creating a jaw pad cover 10 and 10A. Surprisingly, the instant invention provides an added advantage and recognizes a problem and adequately and completely addresses an unfulfilled need, in that the jaw pad cover 10 and 10A, in the manner disclosed, in effect, defines a highly functional, aesthetic and useful apparatus that is not presently available. This is due entirely to the particular way the applicants designed and fabricated the jaw pad cover 10 and 10A, not found or taught in the prior art. By doing so, the applicants are able to use inexpensive materials in the fabrication without sacrificing performance, rather, achieving superior unexpected results, due to the particular construction which is cost effective.

One practical advantage of the invention is that it provides a convenient, practical, low cost, jaw pad cover 10 and 10A which allows a user to conveniently, and in an efficient manner, provide a sanitary, launderable, readily identifiable, way to extend the life of a jaw pad 30. Still another advantage is that the jaw pad cover 10 and 10A is designed for ease of manufacture by standard methods such as by sewing and by using readily available materials particularly chosen for the problem solved.

Of course, a wide variety of further uses and advantages of the present invention will become apparent to one skilled in the art. As disclosed, it is apparent that one skilled in the art will realize that the foregoing discussion outlines the more important features of the invention to enable a better understanding of the instant invention and to instill a better appreciation of the inventors contribution to the art. It must be clear that the disclosed details of construction, descriptions of geometry and illustrations of inventive concepts are mere examples of possible manifestations of the invention.

Although the invention has been shown and described with reference to certain illustrative embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

What is claimed is:

1. A jaw pad cover for expandably fitting by stretching over an assembled jaw pad of a headgear and protectively covering the assembled jaw pad while allowing the assembled jaw pad together with said jaw pad cover thereon to be removably attachable onto the headgear in a conventional manner, said jaw pad cover comprising:

a highly stretchable material blank having a first section and a second section substantially equal in size and in shape;

said first section having a first aperture and a second aperture therein;

wherein the first aperture therein said first section is larger than the second aperture therein said first section to allow the assembled jaw pad to freely pass completely therethrough the first aperture when the first aperture is stretched so that when the assembled jaw pad is positioned therein said jaw pad cover, the first aperture and said highly stretchable material blank recovers to its original shape after stretching over the assembled jaw pad; a fastening means on the assembled jaw pad is accessible therethrough the first aperture and the second aperture therein said first section of said jaw pad cover; and means for joining said first section to said second section.

2. The jaw pad cover of claim 1 wherein said means for joining said first section to said second section of said highly stretchable material blank is a stitch centrally disposed about a perimeter at a juncture where said first section and said second section abut.

3. The jaw pad cover of claim 1 wherein said highly stretchable material blank is a material chosen from the group consisting of nylon, rayon, orlon, rubber, cotton, silk, wool, plastic, a polyurethane with a long-chain synthetic polymeric fiber having soft and rubbery segments of polyester and a polyurethane with a long-chain synthetic polymeric fiber having soft and rubbery segments of polyether polyols.

4. The jaw pad cover of claim 1 wherein said first section is fabricated from rubber and said second section is fabricated from one of nylon, rayon, orlon, cotton, silk, wool, plastic, a polyurethane with a long-chain synthetic polymeric fiber having soft and rubbery segments of polyester and a polyurethane with a long-chain synthetic polymeric fiber having soft and rubbery segments of polyether polyols.

5. The jaw pad cover of claim 1 wherein said first section and said second section are fabricated from one of nylon, rayon, orlon, rubber, cotton, silk, wool, plastic, a polyurethane with a long-chain synthetic polymeric fiber having soft and rubbery segments of polyester and a polyurethane with a long-chain synthetic polymeric fiber having soft and rubbery segments of polyether polyols.

6. A jaw pad cover expandably conforming to a shape of an assembled jaw pad for protectively covering the assembled jaw pad of a headgear, said jaw pad cover comprising:

a highly stretchable material blank having a first section and a second section and having properties allowing recovery to its original shape after stretching over the assembled jaw pad;

said first section substantially equal in size and in shape to said second section;

said first section having a first aperture and a second aperture therein for receiving the assembled jaw pad therein said jaw pad cover wherein the first aperture therein said first section is larger than the second aperture therein said first section to allow the assembled jaw pad to freely pass therethrough the first aperture so that when the assembled jaw pad is positioned therein said jaw pad cover, a fastening means on the assembled jaw pad is accessible therethrough the first aperture and the second aperture therein said first section of said jaw pad cover; and means for joining said first section to said second section.

7. The jaw pad cover of claim 6 wherein said means for joining said first section to said second section of said highly stretchable material blank is a stitch centrally disposed about a perimeter at a juncture where said first section and said second section abut.

8. The jaw pad cover of claim 6 wherein the first aperture and the second aperture in said first section have reinforcement sewn thereabout.

9. The jaw pad cover of claim 6 wherein said highly stretchable material blank is a material chosen from the group consisting of nylon, rayon, orlon, rubber, cotton, silk, wool, plastic, a polyurethane with a long-chain synthetic polymeric fiber having soft and rubbery segments of polyester and a polyurethane with a long-chain synthetic polymeric fiber having soft and rubbery segments of polyether polyols.

10. The jaw pad cover of claim 6 wherein said first section is fabricated from rubber and said second section is fabricated from one of nylon, rayon, orlon, cotton, silk, wool, plastic, a polyurethane with a long-chain synthetic polymeric fiber having soft and rubbery segments of polyester and a polyurethane with a long-chain synthetic polymeric fiber having soft and rubbery segments of polyether polyols.

11. The jaw pad cover of claim 6 wherein said first section and said second section are fabricated from one of nylon, rayon, orlon, rubber, cotton, silk, wool, plastic, a polyurethane with a long-chain synthetic polymeric fiber having soft and rubbery segments of polyester and a polyurethane with a long-chain synthetic polymeric fiber having soft and rubbery segments of polyether polyols.

12. A method of fabricating a jaw pad cover comprising the steps of:

selecting a shape of an assembled jaw pad to be covered;

providing a highly stretchable material blank having properties allowing recovery to its original shape after stretching over the assembled jaw pad;

defining a first section and a second section each conforming to the shape of the assembled jaw pad selected;

fabricating said first section and said second section from said highly stretchable material blank;

forming a first aperture and a second aperture therein said first section wherein the first aperture in said first section is larger than the second aperture therein said first section; and joining said first section and said section together with a stitch centrally disposed about a perimeter at a juncture where said first section and said second section abut each other.

13. A method for protectively covering an assembled jaw pad of a headgear comprising the steps of:

providing the assembled jaw pad;

providing a jaw pad cover constructed from a highly stretchable material blank having a first section and a second section joined together with a stitch and having a first aperture and a second aperture therein said first section wherein the first aperture in said first section is larger than the second aperture therein said first section;

inserting the assembled jaw pad into the first aperture of said jaw pad cover allowing the assembled jaw pad to freely pass completely therethrough; and stretching said jaw pad cover about the assembled jaw pad so that when the assembled jaw pad is positioned therein said jaw pad cover, a fastening means on the assembled jaw pad is accessible therethrough the first aperture and the second aperture therein said first section of said jaw pad cover for mounting the assembled jaw pad covered by said jaw pad cover onto the headgear.

* * * * *